US006386933B1

(12) United States Patent
Rewald et al.

(10) Patent No.: US 6,386,933 B1
(45) Date of Patent: May 14, 2002

(54) ENHANCED CUSTOMIZABLE SURFBOARDS WITH ADJUSTABLE FINS AND METHODS FOR MAKING THE SAME

(76) Inventors: Stephen S. Rewald, 2164 Foxglove Rd., Tustin, CA (US) 92780; Shane E. Johnston, 112 S. Beth Cir., Anaheim, CA (US) 92806

( * ) Notice: Subject to any disclaimer, the term of this patent is extended or adjusted under 35 U.S.C. 154(b) by 0 days.

(21) Appl. No.: 09/409,927

(22) Filed: Sep. 30, 1999

(51) Int. Cl.[7] ..... B63B 35/79
(52) U.S. Cl. ..... 441/74; 114/39.15
(58) Field of Search ..... 114/39.15, 127, 114/132–137, 140, 143; 441/74, 79; D21/769

(56) References Cited

U.S. PATENT DOCUMENTS

| | | | | |
|---|---|---|---|---|
| 4,421,492 A | | 12/1983 | Leva | |
| 4,493,665 A | * | 1/1985 | Liddle | 441/79 |
| 4,804,347 A | | 2/1989 | Ross | |
| 4,811,674 A | * | 3/1989 | Stewart | 114/39.15 |
| 5,328,397 A | | 7/1994 | Whitty | |
| 5,464,359 A | | 11/1995 | Whitty | |
| 5,517,707 A | | 5/1996 | LaMantia | |
| 5,567,190 A | | 10/1996 | Oates | |
| 5,649,846 A | | 7/1997 | Harper et al. | |

FOREIGN PATENT DOCUMENTS

| | | | | |
|---|---|---|---|---|
| DE | 2932750 | * | 3/1981 | |
| WO | WO 91/17080 | * | 11/1991 | 441/79 |

* cited by examiner

*Primary Examiner*—Ed Swinehart
(74) *Attorney, Agent, or Firm*—Eric K. Satermo

(57) ABSTRACT

A surfboard includes a body, a fin, a chamber disposed in the body, and a fastener. The fin is receivable in the chamber and projects from the body at a cant when received in the chamber. The chamber and the fastener may be components of a fin box disposed on the body of the surfboard. The chamber is configured so that the fin is adjustable in a variety of cants. The chamber may be configured to allow a foot of the fin to pivot within the chamber. When the fin is positioned in a desired cant, the fastener secures the fin in the chamber at the desired cant. To adjust the cant, the fastener is actuated to release the fin, the fin is repositioned at another cant, and the fastener is actuated to secure the fin at the new desired cant. This adjustment of the fin may be repeated any number of times.

21 Claims, 7 Drawing Sheets

ENHANCED CUSTOMIZABLE SURFBOARDS WITH ADJUSTABLE FINS AND METHODS FOR MAKING THE SAME

BACKGROUND OF THE INVENTION

1. Field of the Invention

The present invention relates to surfboards and, more particularly, to surfboards with adjustable fins that allow a user to adjust the angle at which the fins project from the surfboard. The present invention also relates to fins and fin boxes used on surfboards.

2. Description of the Related Art

Advancements in the design and manufacture of surfboards have yielded models that are highly responsive to individual user needs and to a wide range of water conditions. More specifically, a surfer may select a surfboard with a particular size and shape depending upon the type, size, and condition of the waves to be surfed. In addition, a surfer may select a board with a particular fin configuration depending upon the surf conditions.

In this regard, designers (who are commonly knowvn in the art as "shapers") develop boards with fins set at a predetermined angle or "cant." For example, a shaper may design a board specifically for well-defined waves with fins having a relatively small cant, such as 4°, and may design another board for "sloppy" waves with fins having a relatively large cant, such as 7°. Accordingly, a surfer may select a board particularly suited for any type of surf conditions.

One of the drawbacks of the current state of the art is that a surfer needs to transport a variety of specialized boards to a surfing locale because it is impossible to predict current surf conditions. This is particularly applicable when the surfer is traveling to distant or foreign locales. In addition, surf condition at a particular locale change throughout a given day, especially in view of wind and tide conditions. Accordingly, the transport a more than one board is inconvenient, a burden, and expensive.

In view of the foregoing, there remains a need in the art of surfboards for surfboards and associated methods and apparatus that eliminate the need of multiple boards by being customizable to suit a variety of surf conditions.

BRIEF SUMMARY OF THE INVENTION

The present invention provides surfboards, fin boxes, and fins, as well as associated methods, that enable a surfer to customize a surfboard as desired and in accordance with various surf conditions. The methods and apparatus of the present invention eliminate the conventional inconvenient need of purchasing, maintaining, and transporting a variety of surfboards to suit various surf conditions. Accordingly, the methods and apparatus of the present invention not only saves a surfer time and money but also enhances the ability of a surfer by enabling a surfer to customize a board to his or her particular tastes.

According to one aspect of the invention, a surfboard includes a body, a fin, a chamber disposed in the body, and a fastener. The fin is receivable in the chamber and projects from the body at a cant when received in the chamber. The chamber is configured so that the fin is adjustable in a variety of cants. For example, the chamber may be configured to allow a foot of the fin to pivot within the chamber. When the fin is positioned in a desired cant, the fastener secures the fin in the chamber at the desired cant.

One of the features of the present invention is that a user may readjust the fin at another cant if desired. To do so, the fastener is actuated to release the fin, the fin is repositioned at another cant, and the fastener is actuated to secure the fin. This process may be repeated any number of times. This adjustable-fin feature is advantageous in that the fins may be positioned at a cant suitable for well-formed waves and then repositioned at another cant if the surf conditions change to the worse. The chamber may be configured to provide a number of predetermined or indexed cants or to provide a substantially continuous number of cants.

According to another aspect of the invention, a fin box may be disposed in the body of the surfboard, with the chamber and the fastener being components of the fin box. In addition, a plurality of fin boxes may be provided so that the surfboard can be provided with a plurality of fins. The chamber may have a number of seats form on a base in the fin box, with each seat providing a predetermined cant.

According to another aspect of the present invention, a fin may be releasably secured in the chamber by the fastener by either a screw system or snap-in system. For example, the fastener may include a screw and a tapped hole configured such that the screw engages a foot of the fin within the chamber. Alternatively, the fastener may include complementary engagement structure respectively disposed on the fin and in the chamber that allows the fin to be snapped into and snapped out of the chamber.

Other aspects, features, and advantages of the present invention will become apparent to those skilled in the art from a consideration of the following detailed description taken in conjunction with the accompanying drawings.

DETAILED DESCRIPTION OF THE INVENTION

Figure 1:
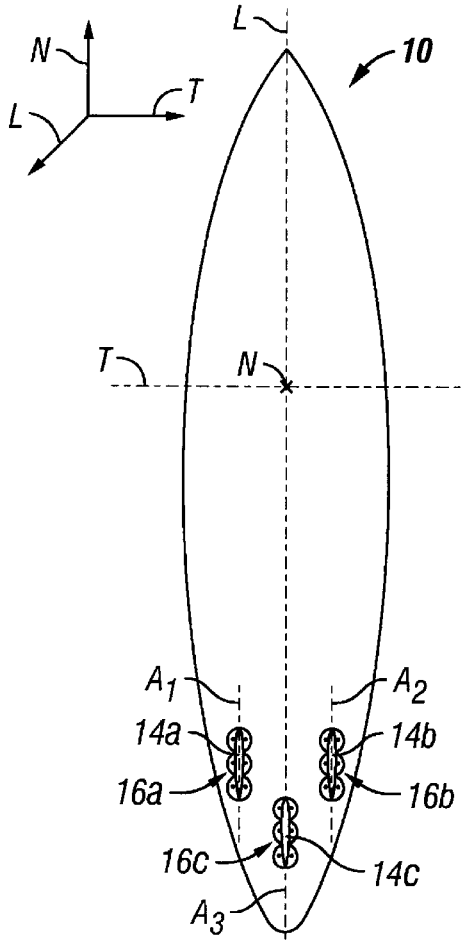
FIG. 1 is a plan view of a customizable surfboard with adjustable fins according to an exemplary embodiment of the invention, particularly illustrating a bottom of the surfboard with a plurality of adjustable fins.

Referring to the drawings in more detail, an enhanced customizable surfboard 10 of the present invention is illustrated in FIG. 1. Exemplary surfboard 10 has a body 12 and at least one but preferably a plurality of fins 14*a*, 14*b*, 14*c*, . . . 14*n*. In accordance with the principles of the present invention, at least one of the fins 14 is adjustable by a user; that is, a user may position and secure one of the fins 14 at a desired angle and then reposition and secure the fin at another angle as desired. In contrast to convention fin systems in which fins are fixed at a predetermined angle or cant, the adjustable-fin feature of the present invention allows a user to adjust the fin or fins 14 as desired and according to the water conditions in which the surfboard 10 is to be used.

For purposes of this description, the body 12 has a longitudinal axis L, a transverse axis T, and a normal axis N perpendicular to axes L and T. In addition, as a numbering convention herein, plural elements are indicated generically with a numeral, e.g., the fins 14, and specifically with an alpha suffix, e.g., central fin 14*c*, and italicized alpha suffixes, e.g., n, are integers greater than 1. Although a surfboard 10 utilized in this description, the principles of the present invention are equally applicable to other analogous water vessels, such as body boards, knee boards, sailboards, wake boards, water skis, and so on, which vessels may be propelled by either waves, wind, or motorized watercraft.

Figure 2:
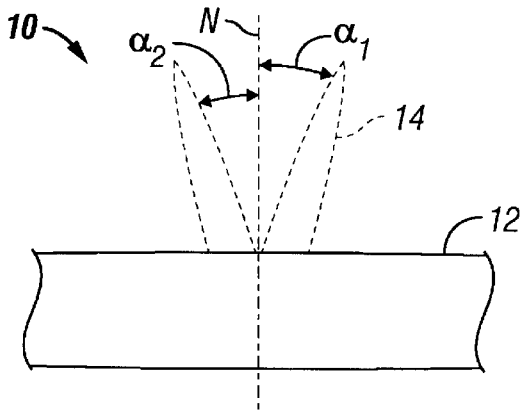
FIG. 2 is a schematic view of a surfboard of the invention, particularly illustrating the adjustment of the cant of a fin.

With continued reference to FIG. 1, each of the fins 14*a*–14*n* is mounted to the body 12 in a corresponding fin box 16*a*–16*n*. According to the present invention, each fin box 16 is configured to allow the fin 14 received therein to be adjusted angularly with respect to the normal axis N of the body 12. More specifically, as shown in FIG. 2, a user may adjust an angle $\alpha$ at which each fin 14 projects from the body 12 of the surfboard 10 as desired, and may readjust angle $\alpha$ as many times as desired.

The angle at which a fin 14 projects from the body 12 of the surfboard is known in the art as cant. As shown in FIG. 2, the cant of fin 14 is defined from the normal axis N as angle $\alpha$. According to the present invention, the fin 14 may be angled from the normal axis N in two directions, the first of which is indicated as angle $\alpha$, and the second of which is indicated as angle $\alpha_2$. According, the total extent through which any fin 14 is pivotal may be defined as the sum of angles $\alpha$, and $\alpha_2$.

Figure 3:
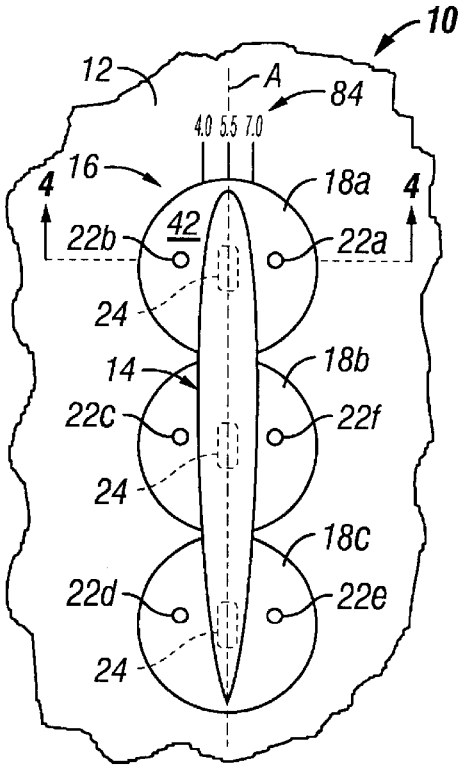
FIG. 3 is a plan view of a fin box with an adjustable fin according to an exemplary embodiment of the invention, particularly illustrating a fin box including a plurality of plugs in substantial alignment.

An exemplary fin box 16 is illustrated in FIG. 3. Exemplary fin box 16 may include one or more plugs 18*a*, 18*b*, 18*c*, . . . 18*n*. Each plug 18 may be disposed on the body 12 as known in the art, for example, as disclosed in U.S. Pat. No. 5,328,397, the entire disclosure of which is incorporated herein by reference. According to multi-plug embodiments of the present invention, the plugs 18 of each fin box 16 are preferably substantially aligned along a respective axis A. Each of the axes A (indicated as axis $A_1$, axis $A_2$, and axis $A_3$ in FIG. 1) may be either substantially parallel or oblique to the longitudinal axis L of the body 12. As shown in FIG. 1, at least one of the fin boxes 16 may be centrally disposed on the body 12 (i.e., fin box 16*c*), and at least one of the fin boxes 16 may be laterally disposed on the body 12 (i.e., fin boxes 16*a* and 16*b*).

Figure 4A:
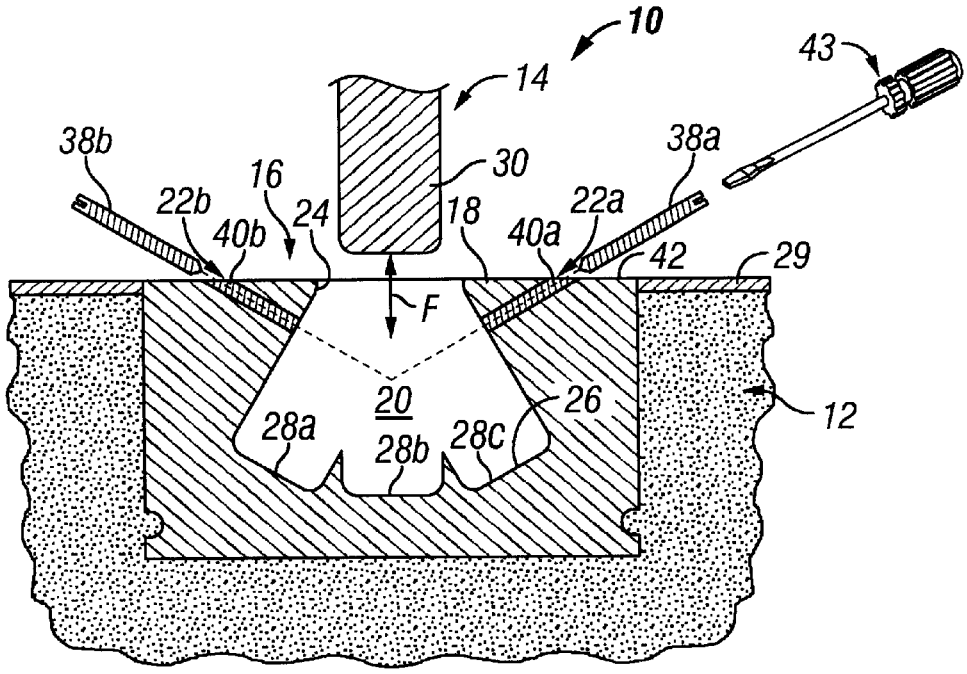
FIG. 4A is a fragmentary cross-sectional view of a fin box with an adjustable fin according to an exemplary embodiment of the invention taken along line 4—4 of either FIG. 3 or FIG. 6, particularly illustrating a fin box that is configured to provide indexed cants.
Figure 4B:
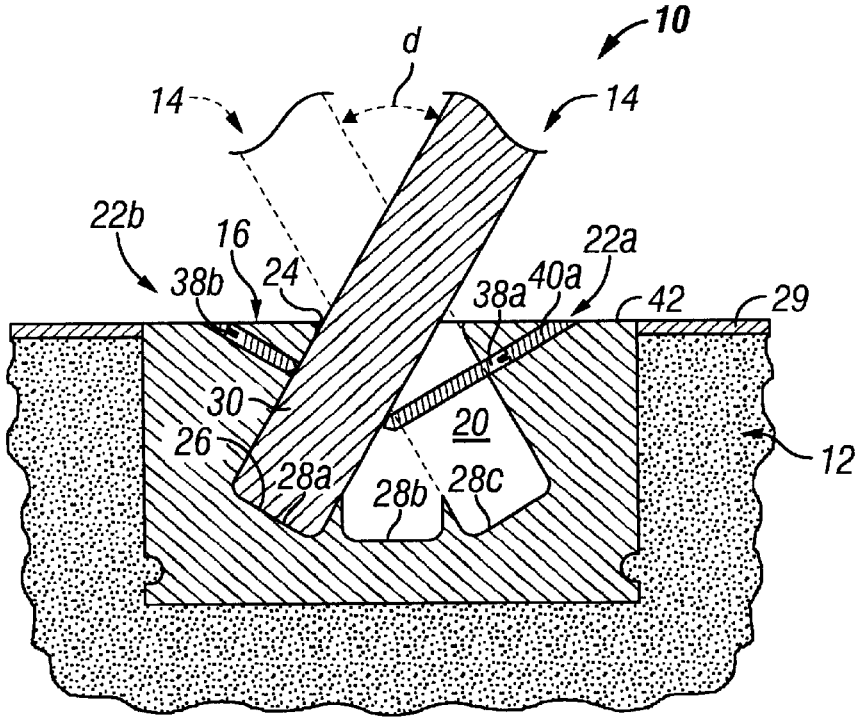
FIG. 4B is a fragmentary cross-sectional view similar to that of FIG. 4A, particularly illustrating the fin box receiving and securing a fin at a desired cant.
Figure 4C:
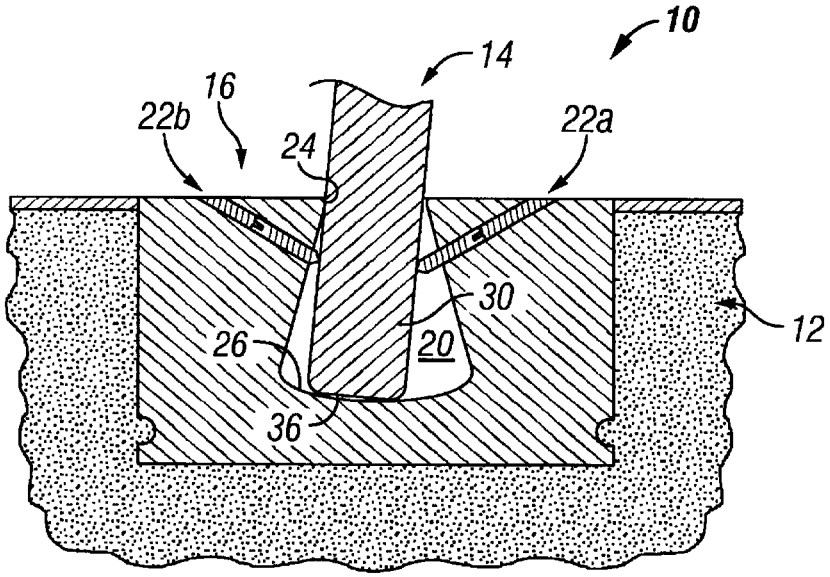
FIG. 4C is a fragmentary cross-sectional view of a fin box with an adjustable fin according to another exemplary embodiment of the invention taken along line 4—4 of either FIG. 3 or FIG. 6, particularly illustrating a fin box that is configured to provide continuous cants.

With additional reference to FIGS. 4A, 4B, 4C, and 4D, according to an exemplary embodiment of the invention, each fin box 16 or, more specifically, each of the plugs 18 may include a chamber 20 for receiving a fin 14 and at least one fastener 22 for securing the fin 14 in the chamber 20. Exemplary chamber 20 has an aperture 24 through which the fin 14 is movable into the chamber 20, as shown by arrow F, and a base 26 oppositely disposed to the aperture 24 against which the fin 14 may be received, which is particularly shown in FIGS. 4B and 4C. Exemplary base 26 may be substantially arcuate, as shown in FIG. 4C, or, alternatively, may include a plurality of seats 28*a*, 28*b*, 28*c*, . . . 28*l* each configured for receiving the fin 14, as shown in FIGS. 4A and 4B. Exemplary fin box 16 may be mounted to the body 12 either before or after the application of an outer layer of glass 29 to the body.

Figure 4D:
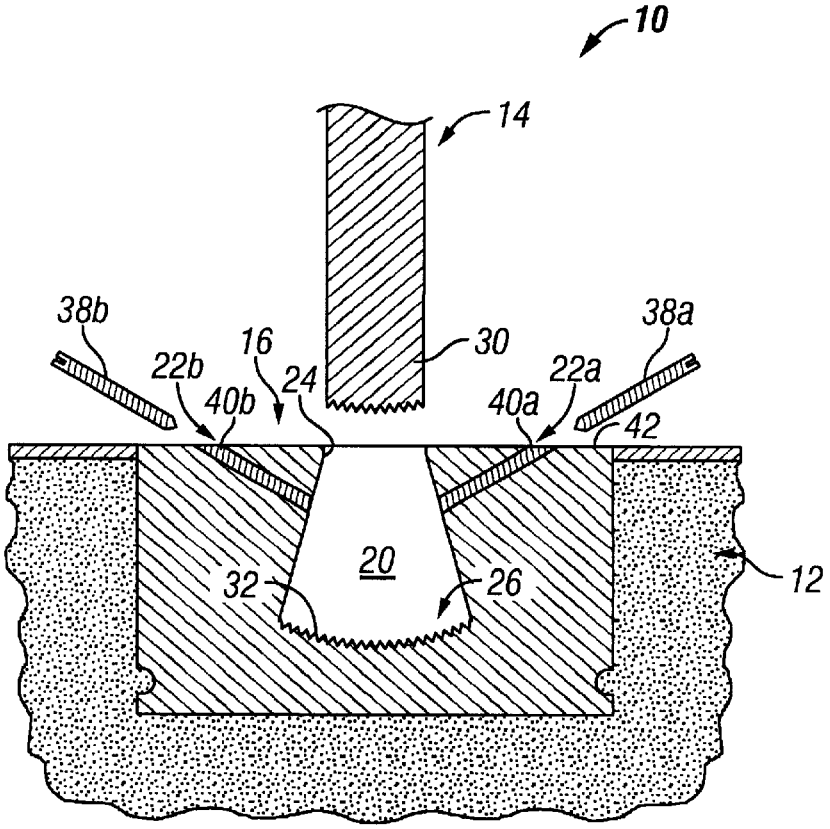
FIG. 4D is a fragmentary cross-sectional view of a fin box with an adjustable fin according to yet another exemplary embodiment of the invention taken along line 4—4 of either FIG. 3 or FIG. 6, particularly illustrating a fin box that is configured to provide a plurality of incremental indexed cants.
Figure 5A:
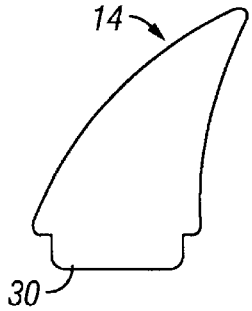
FIG. 5A is a schematic side view of a fin according to an exemplary embodiment of the invention, particularly illustrating a fin with a single foot.
Figure 5B:
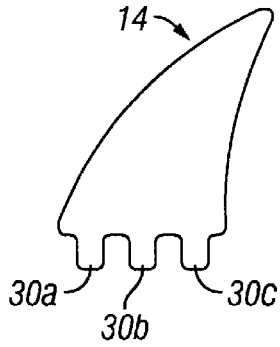
FIG. 5B is a schematic side view of a fin according to another exemplary embodiment of the invention, particularly illustrating a fin with a plurality of feet.

Exemplary fin 14 may include a single foot 30, as shown in FIG. 5A, or a plurality of feet 30*a*, 30*b*, 30*c*, . . . 30*k*, as shown in FIG. 5B, depending upon the configuration of the fin box 16. For example, a fin box 16' as shown in FIG. 4 includes an elongated aperture 24 leading into the chamber 20 (see FIG. 4A) for receiving the single correspondingly elongated foot 30 shown in FIG. 5A. Once received in chamber 20 and positioned at a desired cant, the fasteners 22 may be fastened to secure the foot 30 within the chamber 20 and the fin 14 to the fin box 16, as shown in FIGS. 4B and 4C. The fins 14 may be either substantially planar in shape as shown in the drawings or arcuate as known in the art.

Alternatively, for the fin box 16 shown in FIG. 3, each of the plugs 18 may include a single aperture 24 for receiving a respective foot 30 of the multi-footed fin 14 shown in FIG. 5B. The fin box 16 is configured so that the apertures 24 of the plugs 18 are spaced correspondingly to the spacing of the feet 30 of the fin 14. Accordingly, the feet 30 of the fin 14 are simultaneously receivable through the apertures 24 and in the chambers 20 of multi-chambered fin box 16. Once the fin 14 is positioned at a desired cant, the fasteners 22*a*–22*f* are fastened to secure the feet 30*a*–30*c* within the chambers 20, as shown in FIGS. 4B and 4C.

Further referencing FIGS. 4A and 4B, a user may position the fin 14 in one of the seats 28 to place the fin 14 at a desired cant. The seats 28 therefore provide a plurality of indexed cants from which the user may selected a desired cant. For example, for a wave surfing embodiment of the invention, the seats 28 may be disposed on the base 26 to yield indexed cants selected from a range of about 1° to about 10° and any fraction therebetween, such as 4.0°, 5.5°, and 7.0°. A user may accordingly pivot the fin 14 within the chamber 20 with the aperture 24 acting as a pivot point through a range of indexed cants indicated by angle α. In this regard, the base 26 has a width greater than a width of the aperture 24, and the aperture 24 has a width substantially equal to or slightly greater than a width of the foot 30 of the fin 14.

As an alternative to seats, the base 26 and the fin 14 may have respective complementary engaging surfaces 32 and 34, as shown in FIG. 4D. Exemplary engaging surfaces 32 and 34 may include a plurality of complementary teeth. A user may insert the fin 14 into the chamber and then engage surface 34 of the fin 14 with surface 32 of the base 26 at a desired position that yields a desired cant. In addition to providing indexed cants, the engaging surfaces 32 and 34 further secure the fin 14 within the chamber 20 and prevent lateral movement of the fin 14 in conjunction with the fasteners 22.

As an alternative to indexed cants as provided by the seats 28 shown in FIGS. 4A and 4B, a user may position the fin 14 against the base 26 of the chamber 20 at any desired cant. More specifically, as shown in FIG. 4C, a user may pivot the fin 14 in a continuous motion (i.e., not incremental or indexed) within the chamber 20 until the desired cant is achieved, and may then secure the fasteners 22 as described above. According to this exemplary embodiment, the foot 30 of the fin 14 may have an arcuate end surface 36 complementary to the arcuate base 26.

Figure 6:
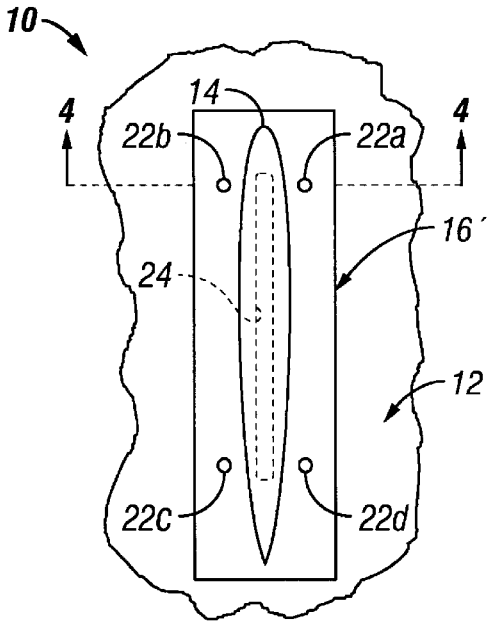
FIG. 6 is a plan view of a fin box with an adjustable fin according to another exemplary embodiment of the invention, particularly illustrating a fin box that is rectangular in configuration.
Figure 7A:
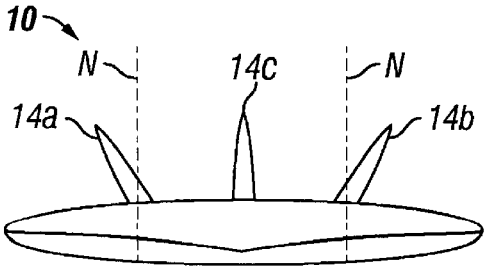
FIG. 7A is a schematic view of a surfboard with adjustable fins of the present invention, particularly illustrating lateral fins adjusted with an outward cant.
Figure 7B:
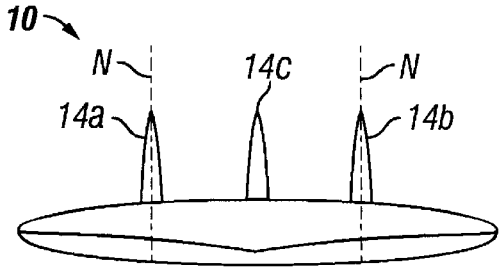
FIG. 7B is a schematic view similar to that of FIG. 7A, particularly illustrating the lateral fins adjusted with a substantially perpendicular cant.

With further reference to FIG. 1 and additional reference to FIGS. 6A, 6B, and 6C, exemplary surfboard 10 includes a plurality of fins 14 and a plurality of fin boxes 16. For example, a pair of lateral fins 14*a* and 14*b* may be provided each with a fin box 16, and a central fin 16*c* may be provided either with or without a fin box 16 as in many embodiments it may be desirable to maintain the central fin 16*c* in a substantially normal or perpendicular position (i.e., having a cant of 0 degrees). Depending upon the surf conditions, a user may adjust the lateral fins 14*a* and 14*b* from an outward cant, as shown in FIG. 6A, to a substantially normal cant, as shown in FIG. 6B. Although typically not configured for wave surfing, the lateral fins 14*a* and 14*b* may also be pivoted to or positioned at an inward cant (not shown).

Referencing FIGS. 4A–4D, each exemplary fastener 22 may include a screw 38 and a correspondingly tapped hole 40. The holes 40 may be positioned in each fin box 16 at an oblique angle, extending from an outer surface 42 of the fin box 16 to the chamber 20, to allow the screws 38 to engage with the foot 30 of the fin 14. Exemplary screws 38 preferably have a length that allows engagement with the fin 14 regardless of the cant, for example, from a relatively small cant, as shown in FIG. 4C, to a relatively large cant, as shown in FIG. 4B. The screws 38 may be adapted to engage with a tool 43, which may be conventional such as a screwdriver or a hex wrench conventional or specialized.

Figure 8:
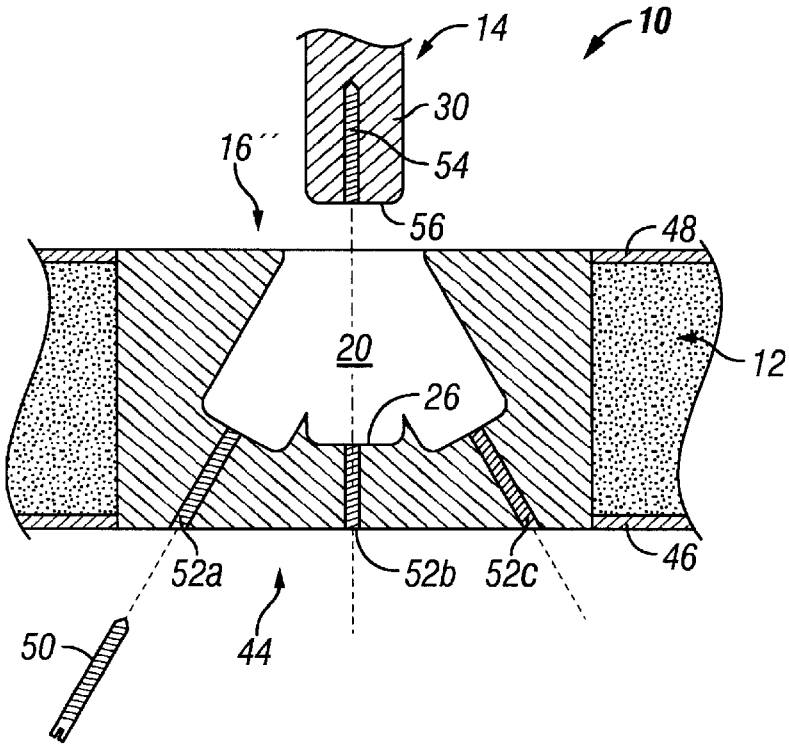
FIG. 8 is a fragmentary cross-sectional view of a fin box according to still another exemplary embodiment of the invention.

An alternative embodiment of exemplary fin box 16 of the invention is shown in FIG. 8, which fin box 16 includes an alternative embodiment of a fastener 44. Exemplary fin box 16" is disposed in the body 12 of the surfboard 10 so as to extend from a top surface 46 of the body to a bottom surface 48 of the body, and includes a chamber 20 as described above. Exemplary fastener 44 includes a screw 50 and a plurality of tapped holes 52*a*, 52*b*, 52*c*, . . . 52*j*. The holes 52 are disposed in the fin box 16 in accordance with desired indexed cants. Exemplary fin 14 complements the fastener 44 with the inclusion of a tapped hole 54 extending upwardly in each foot 30 from a bottom surface 56 thereof. Accordingly, when the foot 30 is received in the chamber 20 and positioned at a desired cant, the fin 14 may be secured by threading the screw 50 through an appropriate hole 52 and into tapped hole 54 of the fin.

Rather than configuring the fastener 22 and 44 of the invention with a screw-and-tapped-hole arrangement, exemplary fastener may be configured as a snap-in fastening system. More particularly, with reference to FIGS. 9A and 9B, exemplary fastener 58 may include a first engagement structure 60 disposed on the base 26 of the chamber 20 and a second engagement structure 62 disposed on the fin 14 or the foot 30 of the fin. The engagement structures 60 and 62 are complementarily configured to releasably engage with each other. For example, the first engagement structure 60 may include a plurality of pins 64*a*, 64*b*, 64*c*, . . . 64*i* arranged in a space relationship at desired indexed cants on the base 26, and the second engagement structure 62 may include a socket 66 formed in each foot 30 of the fin 14.

Figure 9A:
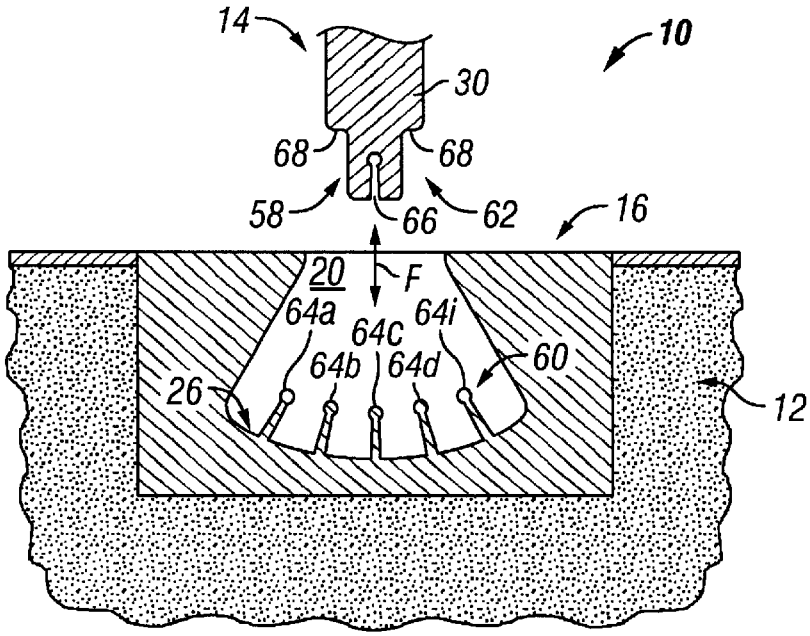
FIG. 9A is a fragmentary cross-sectional view of a fin box with an adjustable fin according to a further exemplary embodiment of the invention, particularly illustrating the fin disengaged from the fin box.
Figure 9B:
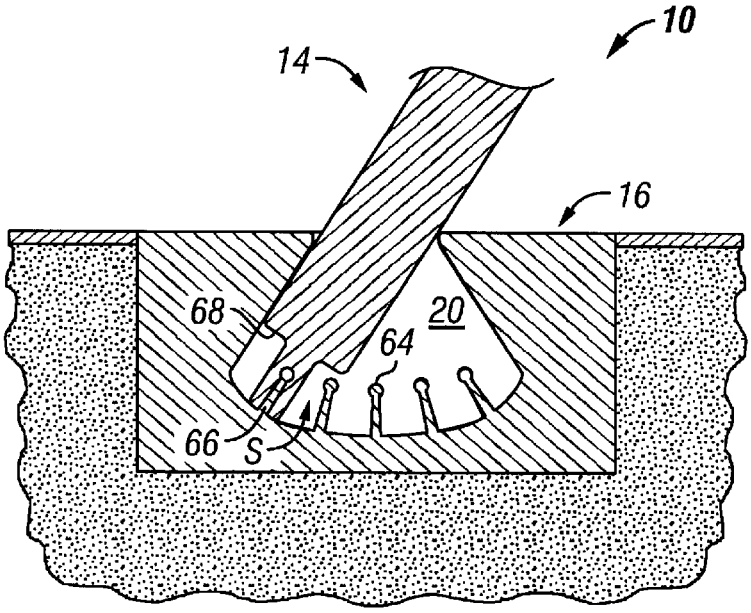
FIG. 9B is a fragmentary cross-sectional view similar to that of FIG. 9A, particularly illustrating the fin engaged with the fin box.

To utilize exemplary fin box 16 show in FIGS. 9A and 9B, the fin 14 is moved into the chamber 20, as shown by arrow F in FIG. 9A, and pivoted to a desired cant. The fin 14 is secured in the fin box 16 by urging the socket 66 onto one of the pins 64 at the desired cant, as shown in FIG. 9B. As can be seen in the drawings, the pins 64 and the socket 66 may be configured with a complementary ball-and-socket locking arrangement so that the pin 64 snaps into and is secured by the socket 66. To maximize the number of pins 64 and, accordingly, the number of indexed cants, each foot 30 of the fin 14 may include a narrowed or notched section defined by shoulders 68. The shoulders 68 accommodate adjacent pins 64, as shown at S in FIG. 9B, when the socket 66 is engaged with a pin. To adjust the cant, the fin 14 is urged outwardly until the socket 66 disengages from the pin, and the fin 14 is positioned at a new desired cant and urged downwardly over a pin at the desired cant.

Figure 10:
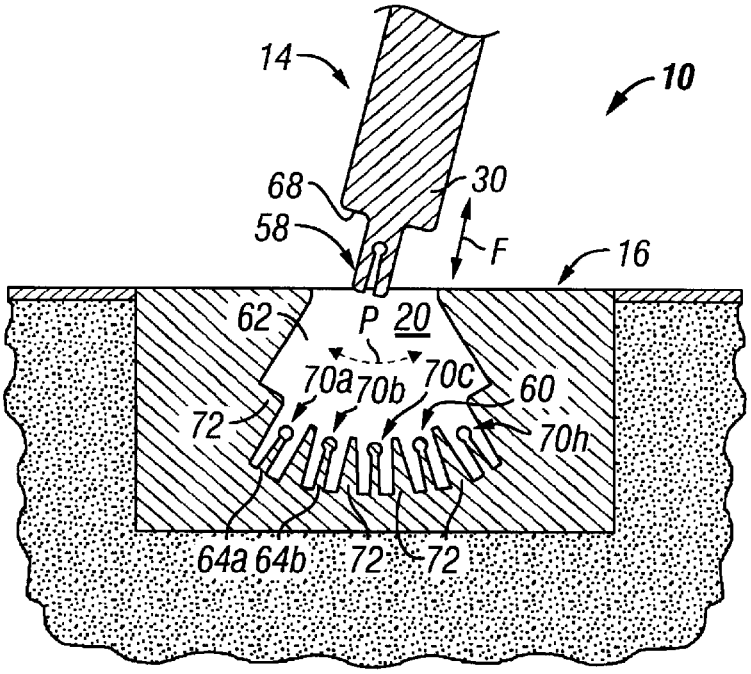
FIG. 10 is a fragmentary cross-sectional view of a fin box with an adjustable fin according to yet another exemplary embodiment of the invention, particularly illustrating a snap-in fastening system of the invention.

Referencing FIG. 10, exemplary first engagement structure 60 may include a plurality of seats 70*a*, 70*b*, 70*c*, . . . 70*h*, with each seat 70 including a respective pin 64. According to this exemplary embodiment, the shoulders 68 of the second engagement structure 60 are configured to accommodate walls 72 of the seats 70. While the pins 64 and the socket 66 releasably retain the foot 30 within the chamber 20, the seats 70 provide lateral stability for the fin 14. To adjust the cant of the fin 14, the engagement structure 60 and 62 are disengaged; the fin 14 is either removed from the chamber 20 and reinserted at a desired cant or pivoted while in the chamber 20 to a desired cant as shown by arrow P; and the engagement structure 60 and 62 are re-engaged.

Figure 11:
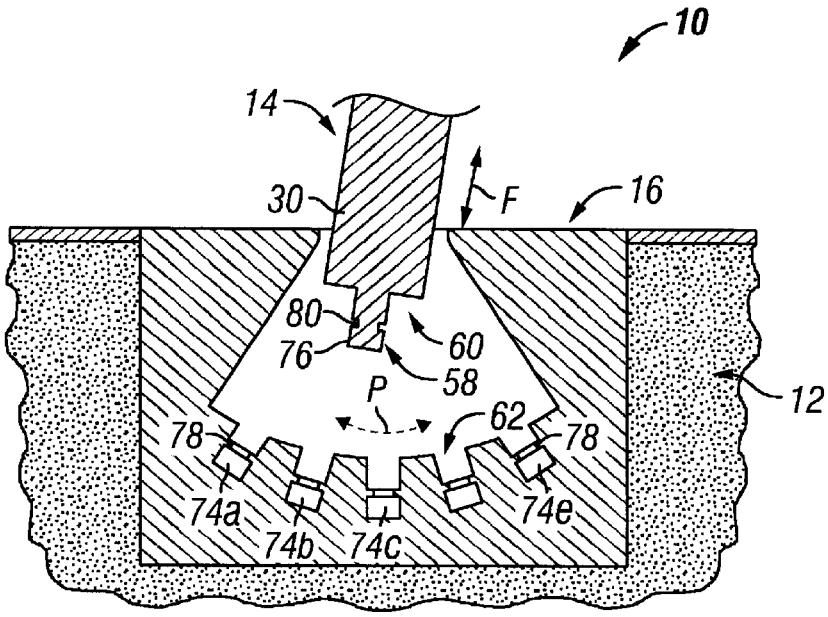
FIG. 11 is a fragmentary cross-sectional view of a fin box with an adjustable fin according to still another exemplary embodiment of the invention, particularly illustrating an alternative embodiment of the snap-in fastening system of the invention.

An alternative embodiment of the fastener 58 of the invention is shown in FIG. 11. According to this embodiment exemplary first engagement structure 60 includes a plurality of sockets 74*a*, 74*b*, 74*c*. . . 74*e* disposed in a space relationship at desired indexed cants on the base 26, and exemplary second engagement structure 62 includes a pin 76 disposed on an end of each foot 30 of the fin 14. The pin 76 is configured to be releasably engageable with the sockets 74. In addition, the pin 76 and the sockets 74 are preferably configured so that the pin 76 snaps into and out of the sockets 74 under moderate force. Accordingly, each of the sockets 74 may include an annular projection 78 and exemplary pin 76 may include a complementary annular notch 80 for engaging with the projections 78.

Figure 12:
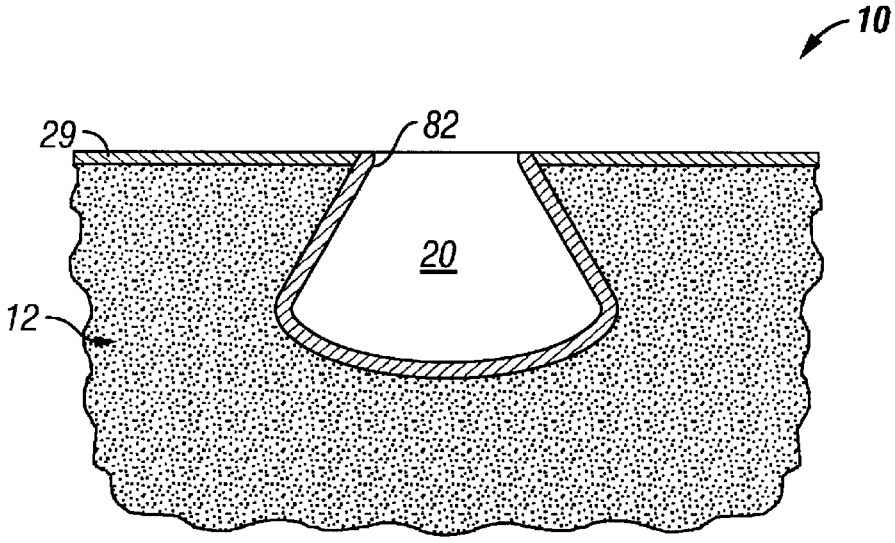
FIG. 12 is a fragmentary cross-sectional view of a customizable surfboard according to another embodiment of the invention, particularly illustrating an embodiment without a dedicated fin box.

Those skilled in the art will understand that the preceding exemplary embodiments of the present invention provide the foundation for numerous alternatives and modifications thereto. For example, with reference to FIG. 12, rather than providing a dedicated fin box as described above, the customizable surfboard 10 of the present invention may be configured with the chamber 20' disposed directly in the body 12. According to this embodiment, exemplary chamber 20' functions analogous to that described above. If desired, the chamber 20' may be reinforced with a layer of resin 82. In addition, with reference to FIG. 3, indicia 84 may be printed on the outer surface 42 of the fin box 16 to indicate a number of predetermined indexed cants. These and other modifications are also within the scope of the present invention. Accordingly, the present invention is not limited to that precisely as shown and described above but by the scope of the appended claims.

What is claimed is:

1. A surfboard comprising:

a body;

a fin; and a chamber disposed on said body for receiving said fin; and a fastener including a screw and a complementary tapped hole disposed in said body such that said screw engages said fin when said fin is received in said chamber and said screw is advanced in said hole;

said fin projecting from said body and having a cant with respect to said body when received in said chamber;

said chamber being configured so that said cant is adjustable; and said fastener for securing said fin at a desired cant.

2. A surfboard as claimed in claim 1 wherein said body has a longitudinal axis and a normal axis perpendicular thereto;

said cant being defined with respect to said normal axis; and said chamber being configured so that said cant is adjustable by at least about 1 degree.

3. A surfboard as claimed in claim 2 wherein said chamber is configured so that said cant is adjustable in two directions with respect to said normal axis.

4. A surfboard as claimed in claim 1 further comprising a plurality of said fins and a corresponding plurality of said chambers.

5. A surfboard as claimed in claim 1 wherein said fin includes at least one foot receivable within said chamber.

6. A surfboard as claimed in claim 5 wherein said chamber includes an aperture through which said foot is movable to be received within said chamber.

7. A surfboard as claimed in claim 6 wherein said chamber includes a base disposed oppositely to said aperture.

8. A surfboard as claimed in claim 7 wherein said base has a width greater than a width of said aperture.

9. A surfboard as claimed in claim 8 wherein aperture has a width slightly greater than a width of said foot of said fin such that said foot is pivotal within said chamber at said aperture.

10. A surfboard as claimed in claim 7 wherein said base is configured to engage with said foot of said fin.

11. A surfboard as claimed in claim 7 wherein said chamber includes a plurality of seats disposed on said base for receiving said foot.

12. A surfboard as claimed in claim 1 further comprising a plurality of said fasteners.

13. A surfboard as claimed in claim 1 wherein said fastener includes a screw and a complementary tapped hole disposed in said body so that said screw engages said fin when said fin is received in said chamber and said screw is advanced in said hole.

14. A surfboard as claimed in claim 1 wherein said fastener includes a first engagement structure disposed on said base and a second engagement structure complementary to said first engagement structure disposed on said fin.

15. A surfboard as claimed in claim 1 further comprising a fin box disposed on said body;

said fin box including said chamber and said fastener.

16. A fin box for a surfboard, said fin box being disposable on a body of the surfboard, said fin box comprising:

a chamber for receiving a fin so that the fin projects from the body and has a cant with respect to the body when received in said chamber; and a fastener including a screw for engaging with a complementary tapped hole formed in the body such that said screw engages the fin when the fin is received in said chamber and said screw is advanced in the hole;

said chamber being configured so that said cant is adjustable; and said fastener for securing said fin at a desired cant.

17. A fin box as claimed in claim 16 wherein said chamber is configured so that said fin is pivotal therein to adjust said cant.

18. A fin box as claimed in claim 16 further comprising a fin with a foot;

said foot being configured to be receivable within said chamber.

19. A method for adjusting a fin of a surfboard, said method comprising the steps of:

a) providing a surfboard including:

a body;

a fin; and a fin box disposed on said body, said fin box including:

a chamber for receiving said fin so that said fin projects from said body and has a cant with respect to said body when received in said fin box; and a fastener including a screw and a complementary tapped hole disposed in said body such that said screw engages said fin when said fin is received in said chamber and said screw is advanced in said hole;

said chamber being configured so that said fin is pivotal therein;

b) inserting said fin into said chamber;

c) pivoting said fin to a desired cant; and d) fastening said fastener so that said fin is secured at said desired cant.

20. A method as claimed in claim 19 further comprising the steps of:

e) unfastening said fastener;

f) pivoting said fin to another desired cant; and g) fastening said fastener.

21. A method as claimed in claim 20 further comprising the step of:

repeating steps (e) through (g) a plurality of times.

* * * * *